US010004295B2

(12) United States Patent
Gerber

(10) Patent No.: US 10,004,295 B2
(45) Date of Patent: Jun. 26, 2018

(54) ARTICLE OF FOOTWEAR WITH PROTECTIVE MEMBER FOR A CONTROL DEVICE

(75) Inventor: Clifford B. Gerber, West Linn, OR (US)

(73) Assignee: NIKE, INC., Beaverton, OR (US)

( * ) Notice: Subject to any disclaimer, the term of this patent is extended or adjusted under 35 U.S.C. 154(b) by 723 days.

(21) Appl. No.: 13/481,132

(22) Filed: May 25, 2012

(65) Prior Publication Data

US 2013/0312293 A1 Nov. 28, 2013

(51) Int. Cl.

| | |
|---|---|
| ***A43B 23/08*** | (2006.01) |
| ***A43B 23/17*** | (2006.01) |
| ***A43C 11/16*** | (2006.01) |
| ***A43B 23/02*** | (2006.01) |

(52) U.S. Cl.

CPC ..... *A43B 23/028* (2013.01); *A43B 23/088* (2013.01); *A43B 23/17* (2013.01); *A43C 11/165* (2013.01)

(58) Field of Classification Search

CPC ..... A43B 3/0047; A43B 5/02; A43B 23/088; A43C 11/165

USPC ..... 36/114, 128, 132, 136

See application file for complete search history.

(56) References Cited

U.S. PATENT DOCUMENTS

| | | | | |
|---|---|---|---|---|
| 4,616,524 | A | 10/1986 | Bidoia | |
| 4,653,204 | A | 3/1987 | Morell et al. | |
| 5,012,598 | A | 5/1991 | Baggio et al. | |
| 5,157,813 | A * | 10/1992 | Carroll | 24/68 SK |
| 5,511,325 | A | 4/1996 | Hieblinger | |
| 7,331,126 | B2 | 2/2008 | Johnson | |
| 7,591,050 | B2 | 9/2009 | Hammerslag | |
| 2006/0156517 | A1* | 7/2006 | Hammerslag et al. | 24/68 SK |
| 2007/0169378 | A1 | 7/2007 | Sodeberg et al. | |
| 2008/0066272 | A1 | 3/2008 | Hammerslag et al. | |
| 2009/0172928 | A1 | 7/2009 | Messmer et al. | |
| 2009/0184189 | A1 | 7/2009 | Sodeberg et al. | |
| 2009/0199435 | A1 | 8/2009 | Robinson, Jr. et al. | |
| 2010/0139057 | A1* | 6/2010 | Soderberg | A43C 11/16 24/68 R |
| 2012/0167281 | A1* | 7/2012 | Gennrich et al. | 2/410 |
| 2013/0269219 | A1* | 10/2013 | Burns et al. | 36/136 |

* cited by examiner

*Primary Examiner* — Sharon M Prange
(74) *Attorney, Agent, or Firm* — Wissing Miller LLP

(57) ABSTRACT

A protective member for an article of footwear includes protruding portions that are configured to prevent incidental contact with a control device. The protective member can be attached to a heel member. The protective member can include shallow portions that allow a user access to the control device.

13 Claims, 12 Drawing Sheets

ARTICLE OF FOOTWEAR WITH PROTECTIVE MEMBER FOR A CONTROL DEVICE

BACKGROUND

The present embodiments relate generally to protective members for control devices associated with articles of footwear.

Articles of footwear generally include two primary elements: an upper and a sole. The upper may be formed from a variety of materials that are stitched or adhesively bonded together to form a void within the footwear for comfortably and securely receiving a foot. The sole is secured to a lower portion of the upper and is generally positioned between the foot and the ground. In many articles of footwear, including athletic footwear styles, the sole often incorporates an insole, a midsole, and an outsole.

SUMMARY

In one aspect, a heel member for an article of footwear includes a first side portion, a second side portion and a rearward portion. The heel member also includes a hole disposed in the rearward portion, where the hole is configured to receive a control device. The heel member portion includes a proximal surface and a distal surface. The heel member also includes at least one protruding portion extending outwardly from the distal surface. The at least one protruding portion is disposed adjacent to the hole.

In another aspect, an article of footwear includes a heel portion with an exterior surface. The heel portion includes a receiving region, where the receiving region is configured to receive a control device. A protruding portion extends outwardly from the exterior surface of the heel portion and the protruding portion is disposed adjacent to the receiving region.

In another aspect, a heel member for an article of footwear includes a first side portion, a second side portion and a rearward portion. The heel member also includes a protective member extending outwardly from a distal surface of the rearward portion. The protective member includes a first protruding portion, a first shallow portion and a second protruding portion. The first protruding portion and the second protruding portion extend further from the distal surface than the first shallow portion.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

DETAILED DESCRIPTION

Figure 1:
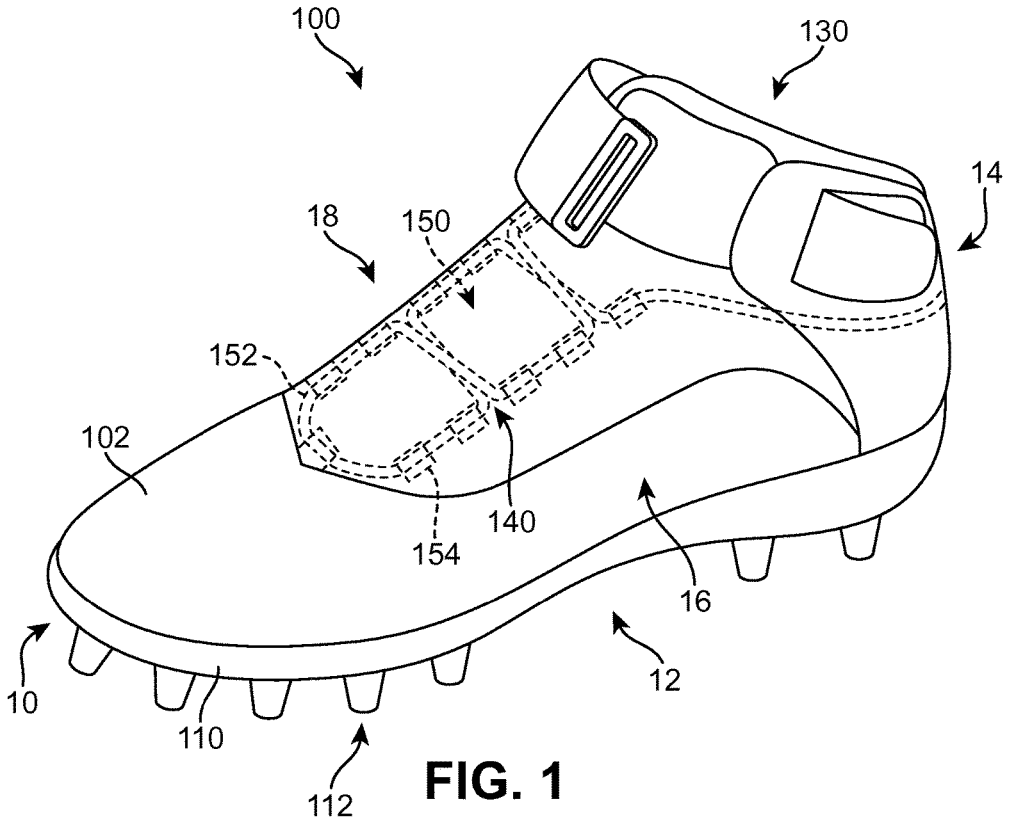
FIG. 1 is an isometric view of an embodiment of an article of footwear including a fastening system.
Figure 2:
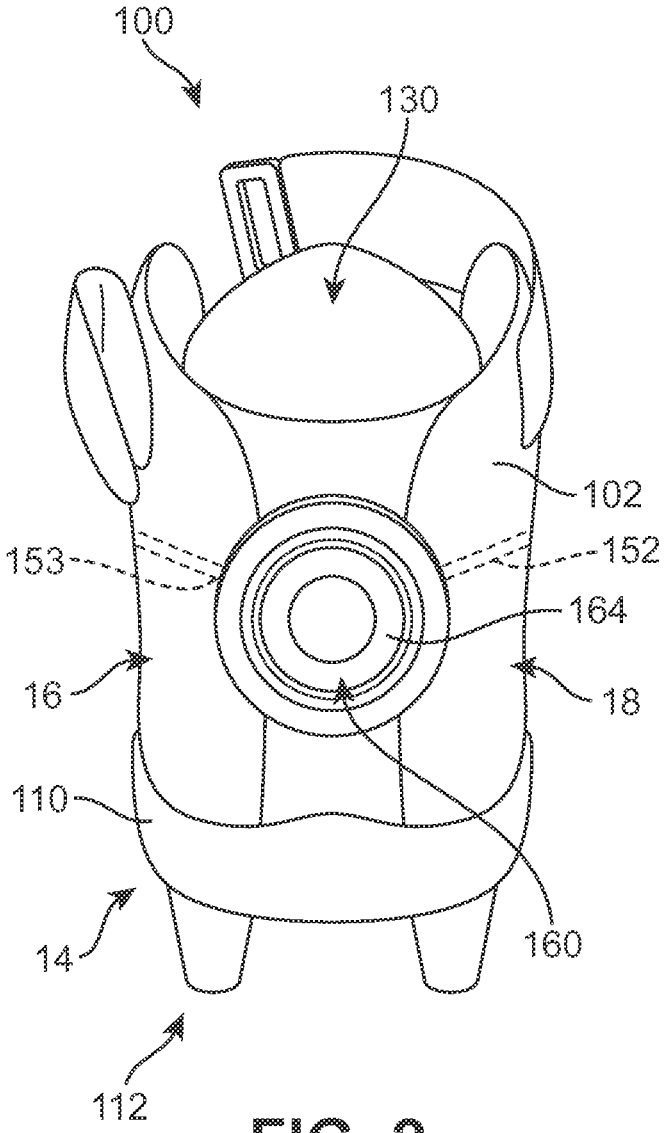
FIG. 2 is a rear view of an embodiment of an article of footwear with a fastening system that includes a control device.

FIGS. 1 and 2 illustrate views of an embodiment of article of footwear 100, or simply article 100. For clarity, the following detailed description discusses an exemplary embodiment, in the form of a sports shoe, but it should be noted that the present embodiments could take the form of any article of footwear including, but not limited to: hiking boots, soccer shoes, football shoes, sneakers, rugby shoes, basketball shoes, baseball shoes, any kind of non-athletic shoes, as well as other kinds of shoes.

For purposes of reference, article 100 may be divided into forefoot portion 10, midfoot portion 12 and heel portion 14. Forefoot portion 10 may be generally associated with the toes and joints connecting the metatarsals with the phalanges. Midfoot portion 12 may be generally associated with the arch of a foot. Likewise, heel portion 14 may be generally associated with the heel of a foot, including the calcaneus bone. In addition, article 100 may include lateral side 16 and medial side 18. In particular, lateral side 16 and medial side 18 may be opposing sides of article 100. Furthermore, both lateral side 16 and medial side 18 may extend through forefoot portion 10, midfoot portion 12 and heel portion 14.

It will be understood that forefoot portion 10, midfoot portion 12 and heel portion 14 are only intended for purposes of description and are not intended to demarcate precise regions of article 100. Likewise, lateral side 16 and medial side 18 are intended to represent generally two sides of article 100, rather than precisely demarcating article 100 into two halves. In addition, forefoot portion 10, midfoot portion 12 and heel portion 14, as well as lateral side 16 and medial side 18, can also be applied to individual components of an article, such as an upper, sole structure, or any other component.

For consistency and convenience, directional adjectives are employed throughout this detailed description corresponding to the illustrated embodiments. The term "longitudinal" as used throughout this detailed description and in the claims refers to a direction extending a length of an article. In some cases, the longitudinal direction may extend from a forefoot portion to a heel portion of the article. Also, the term "lateral" as used throughout this detailed description and in the claims refers to a direction extending a width of the article. In other words, the lateral direction may extend between a medial side and a lateral side of the article. Furthermore, the term "vertical" as used throughout this detailed description and in the claims refers to a direction generally perpendicular to a lateral and longitudinal direction. For example, in cases where a sole structure is planted flat on a ground surface, the vertical direction may extend from the ground surface upward. In addition, the term "proximal" refers to a portion of a footwear component that is closer to a portion of a foot when an article of footwear is worn. Likewise, the term "distal" refers to a portion of a footwear component that is further from a portion of a foot when an article of footwear is worn. It will be understood that each of these directional adjectives may be applied to individual components of an article of footwear.

Article 100 may include upper 102 and sole structure 110. In some embodiments, sole structure 110 may be configured to provide traction for article 100. In addition to providing traction, sole structure 110 may attenuate ground reaction forces when compressed between the foot and the ground during walking, running or other ambulatory activities. The configuration of sole structure 110 may vary significantly in different embodiments to include a variety of conventional or non-conventional structures. In some cases, the configuration of sole structure 110 can be configured according to one or more types of ground surfaces on which sole structure 110 may be used. Examples of ground surfaces include, but are not limited to: natural turf, synthetic turf, dirt, as well as other surfaces.

In different embodiments, sole structure 110 may include different components. For example, sole structure 110 may include an outsole, a midsole, and/or an insole. In addition, in some cases, sole structure 110 can include one or more cleat members that are configured to increase traction with a ground surface. A cleat member may be configured to penetrate into a ground surface in order to facilitate traction, stability and/or control for a user. In one embodiment, sole structure 110 includes plurality of cleat members 112. In other cases, however, sole structure 110 may not include any cleat members.

In some embodiments, sole structure 110 may be joined with upper 102. In some cases, upper 102 is configured to wrap around a foot and secure sole structure 110 to the foot. In some cases, upper 102 may include opening 130 that provides access to an interior cavity of article 100.

Article 100 can include provisions for adjusting one or more components or systems. In some cases, article 100 can include a control device that may be integrated into upper 102 and/or sole structure 110. The term "control device" as used throughout this detailed description and in the claims refers to any device that can be manipulated by a user to adjust a component or system. One example of a control device, described in detail below, is a tension control device that allows a user to adjust the tension of a fastening system. As another example, an article with an adjustable pressure bladder could include a pressure control device that allows a user to manually change the pressure of the bladder. A pressure control device could take the form of a push-button pressure pump, a pressure control dial as well as any other kind of pressure control device. Still other examples include electronic control devices that may be used to control electronic systems in footwear, including, for example, lighting systems or any other kinds of electronic systems.

In one embodiment, article 100 may include control device 160. In some cases, control device 160 may be a tension control device that may be used with fastening system 150. In an exemplary embodiment, fastening system 150 may be a cable-type lacing system. However, other embodiments can include any other types of fastening systems. Examples of different fastening systems are known in the art and may include, but are not limited to: lacing systems, cable based systems, strap based systems, zipper systems, hook and loop fastener systems (such as Velcro systems) as well as any other kinds of fastening systems.

In one embodiment of fastening system 150, lace member 152 may be guided through plurality of lace guides 154. In some cases, plurality of lace guides 154 may be anchored to opposing sides of throat region 140. With this configuration, as lace member 152 is tightened, throat region 140 may constrict in size to tighten around the foot.

In some embodiments, control device 160 may be used to control the tension of lace member 152. In some cases, control device 160 may comprise a housing that receives end portions 153 of lace member 152. In order to increase the tension of fastening system 150, a user may manipulate control device 160. For example, in some cases, a user may turn reel portion 164 to wind lace member 152.

It will be understood that the current embodiment is only intended to illustrate one possible embodiment of a tension control device. In particular, the embodiments are not intended to be limited to any particular design for a tension control device. Moreover, as discussed above, other embodiments could include other types of control devices configured for controlling any other footwear systems.

In different embodiments, the location of a control device could vary. In some cases, a control device could be disposed in an upper of an article. In other cases, a control device could be disposed in a sole structure of an article. In some cases, a control device may be disposed in a forefoot portion, a midfoot portion and/or a heel portion of an upper or sole structure. Furthermore, in some cases, a control device could be disposed internally to a footwear component (e.g. inside an upper or inside a sole structure). In still other cases, a control device could be disposed externally to a footwear component (e.g. outside an upper or outside a sole structure). In some embodiments, portions of a control device may be exposed externally to an article, while other portions may be disposed within components of an article.

In some cases, control device 160 may be disposed in heel portion 14 of upper 102. Placing control device 160 in heel portion 14 may facilitate ease of use and may help reduce the chances of inadvertent contact with control device 160. However, in other embodiments, control device 160 could be located at any other portion of article 100.

Figure 3:
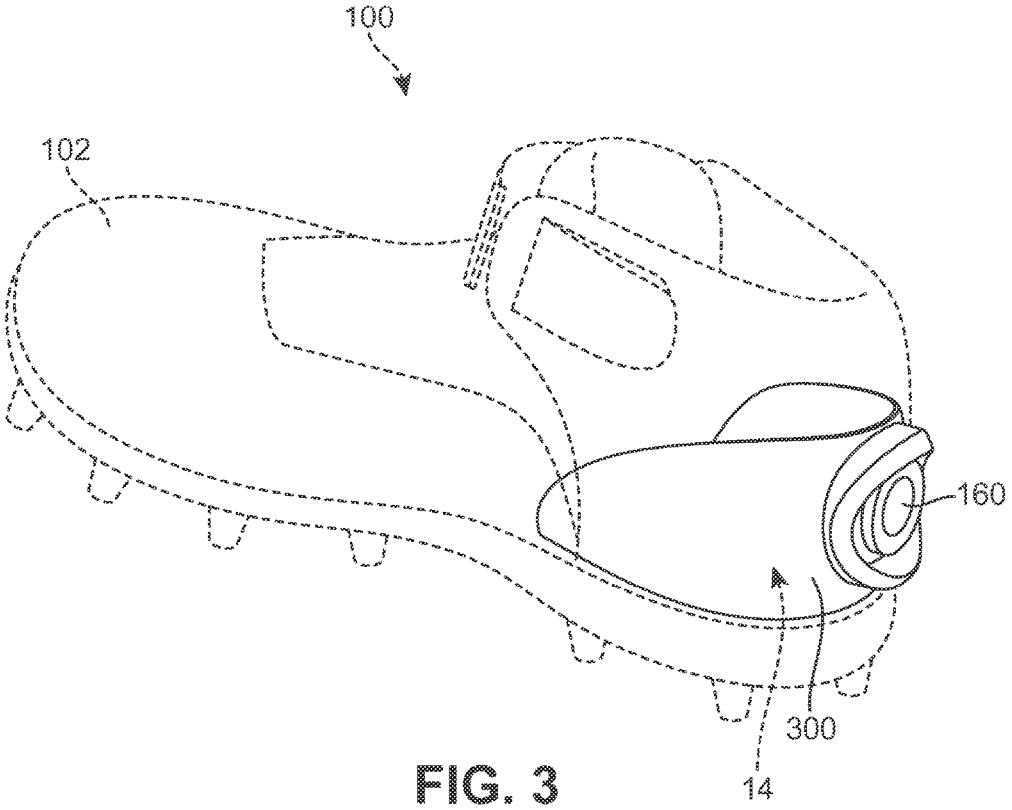
FIG. 3 is a rear isometric view of an embodiment of an article of footwear including a heel member, where the upper of the article of footwear is shown in phantom.
Figure 4:
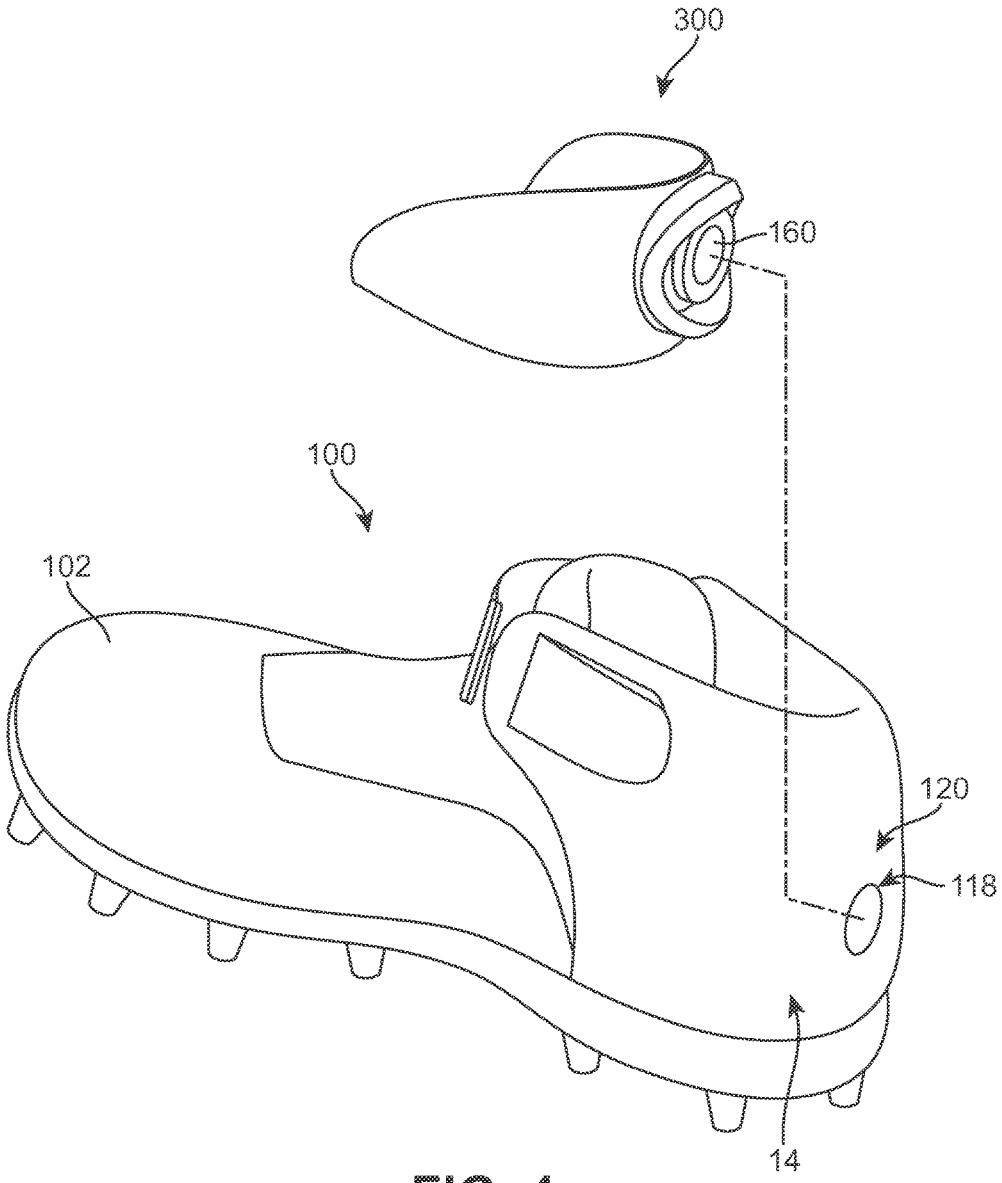
FIG. 4 is a rear isometric exploded view of an embodiment of an article of footwear and a corresponding heel member.

FIG. 3 illustrates a schematic rear isometric view of an embodiment of article 100 that further includes heel member 300. FIG. 4 illustrates a schematic exploded isometric view of an embodiment of a possible arrangement between heel member 300, article 100 and control device 160. For purposes of clarity, article 100 is shown in phantom in FIG. 3.

Referring to FIGS. 3 and 4, heel member 300 may generally be associated with heel portion 14 of article 100.

In some cases, heel member 300 could be a heel counter that may be attached to upper 102. In other cases, heel member 300 could be a heel cup or similar provision that is integrated into a portion of sole structure 110. Using heel member 300 may provide support and reinforcement for heel portion 14 of article 100.

In some embodiments, heel member 300 may retain a portion of control device 160. For example, in some cases, a portion of control device 160 may be inserted through a hole in heel member 300, as discussed in further detail below. Moreover, in some cases, upper 102 may include hole 118 that is aligned with control device 160. This arrangement allows a portion of control device 160 to be exposed along exterior surface 120 of upper 102.

Figure 5:
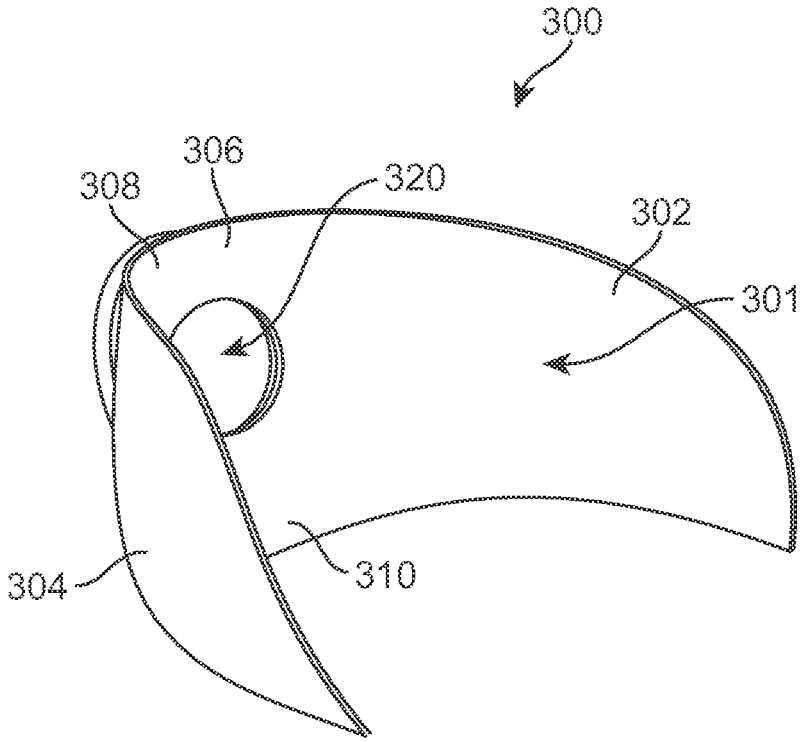
FIG. 5 is an isometric view of an embodiment of a heel member.
Figure 6:
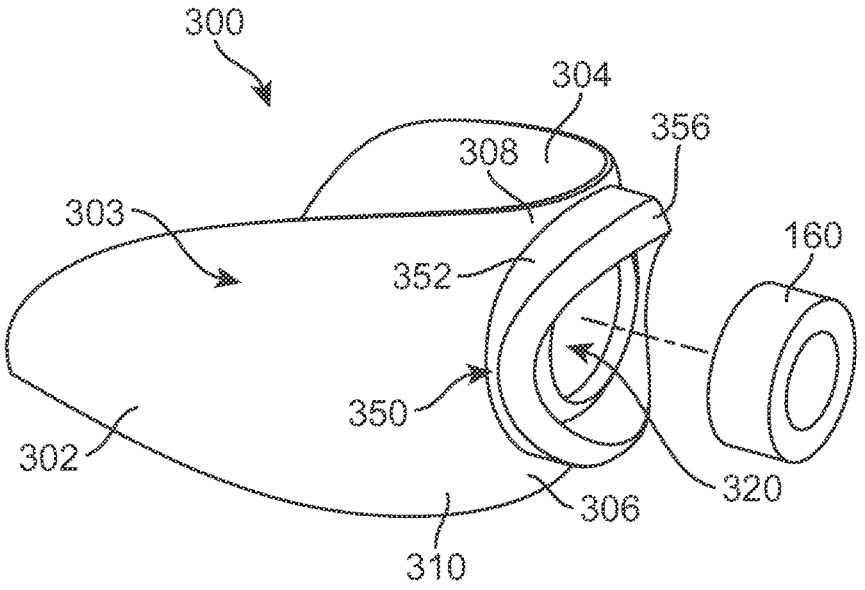
FIG. 6 is an isometric view of an embodiment of a heel member and a corresponding control device.

FIGS. 5 and 6 illustrate front and rear schematic views, respectively, of heel member 300. For purposes of illustrating a possible relationship between control device 160 and heel member 300, control device 160 is shown along with heel member 300 in FIG. 5. Generally, heel member 300 may comprise a cupped member that is configured to wrap around the heel of the foot. In some cases, heel member 300 includes first side portion 302, second side portion 304 and rearward portion 306. Rearward portion 306 further includes upper portion 308 and lower portion 310.

In some cases, heel member 300 may be characterized by one or more surfaces. In some cases, heel member 300 can include proximal surface 301. Proximal surface 301 may be an inwardly facing surface. In some cases, heel member 300 may include distal surface 303. Distal surface 303 may be an outwardly facing surface. In other words, proximal surface 301 may confront a foot when the foot is inserted into article 100, while distal surface 303 may be disposed against an inner surface of upper 102.

In some cases, heel member 300 may include provisions for associating with a control device. In some cases, for example, heel member 300 may include hole 320. In some cases, hole 320 allows portions of a control device to be inserted through heel member 300.

Generally, one or more holes could be disposed on any portion of heel member 300. In some cases, hole 320 could be disposed on first side portion 302 of heel member 300. In other cases, hole 320 could be disposed on second side portion 304 of heel member 300. In one embodiment, hole 320 could be disposed on rearward portion 306 of heel member 300. Moreover, in still other embodiments, multiple different holes could be disposed in first side portion 302, second side portion 304 and/or rearward portion 306 of heel member 300.

In some embodiments, hole 320 may be generally aligned with hole 118 of upper 102 (see FIG. 4). In some cases, for example, control device 160 may be inserted through both hole 118 as well as hole 320. In other cases, however, hole 118 and hole 320 may not be aligned. Moreover, it will be understood that the sizes and shapes of hole 118 and/or hole 320 may be varied to accommodate different control devices.

In embodiments where control device 160 is a tension control device, control device 160 may have a release mechanism that allows a user to release the tension of fastening system 150. However, incidental contact with control device 160 could cause the release mechanism to be inadvertently engaged. This could lead to user frustration if they are required to constantly readjust the tension of fastening system 150.

In some embodiments, article 100 can include provisions for preventing accidental engagement of a control device. In some cases, article 100 can include a protective member that acts to prevent accidental contact with, or engagement of, control device 160. In some cases, the protective member could include protruding portions that extend further out from an article than control device 160.

Figure 7:
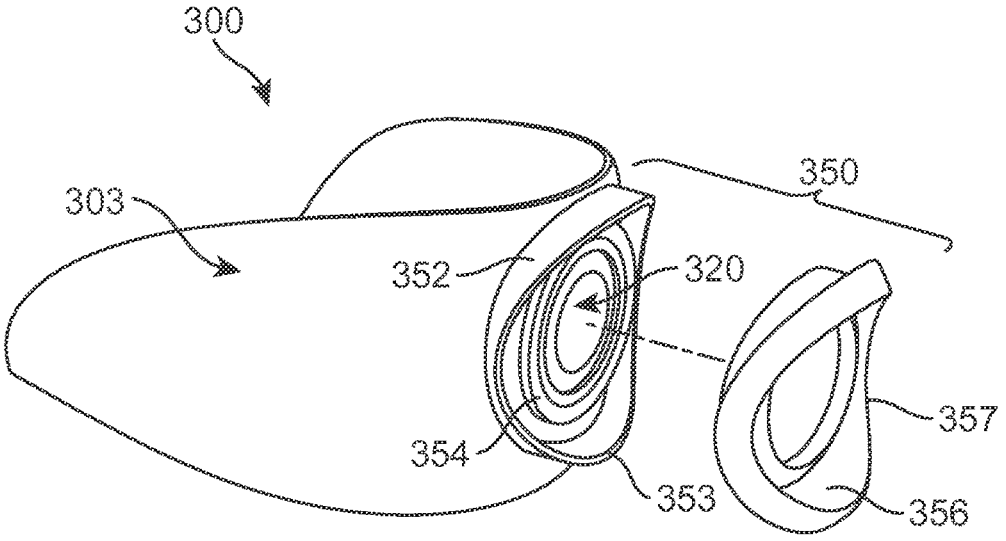
FIG. 7 is an isometric view of an embodiment of a heel member, in which a covering portion of a protective member is exploded away from a base portion of the protective member.

FIG. 7 illustrates another schematic view of heel member 300. Referring now to FIGS. 6 and 7, in one embodiment, heel member 300 can include protective member 350. Generally, protective member 350 may comprise any structure that is configured to control or limit contact with control device 160. In particular, protective member 350 may comprise any structure that extends outwardly from heel member 300 in an area adjacent to control device 160.

Generally, protective member 350 may comprise any number of components. In some cases, protective member 350 may comprise a single monolithic component of material. In other cases, protective member 350 may comprise multiple different components that are joined together. In one embodiment, for example, protective member 350 further includes base portion 352, mounting portion 354 and covering portion 356.

In some cases, base portion 352 and mounting portion 354 may be attached directly to distal surface 303 of heel member 300. Any method known in the art for attaching base portion 352 and/or mounting portion 354 to heel member 300 could be used. For example, in some cases, base portion 352 and mounting portion 354 may be attached to heel member 300 using an adhesive. In other cases, base portion 352 and mounting portion 354 could be integrally formed with heel member 300. This could occur, for example, through a molding process in which base portion 352 and/or mounting portion 354 may be simultaneously formed with heel member 300. In other cases, however, base portion 352 and/or mounting portion 354 may not be attached directly to heel member 300.

In some cases, covering portion 356 may be joined to mounting portion 354. Generally, covering portion 356 may be joined with mounting portion 354 in any manner. In one embodiment, covering portion 356 may include fastening pegs that can be inserted into corresponding holes of mounting portion 354. In another embodiment, covering portion 356 may be attached to mounting portion 354 using an adhesive of some kind. In still other cases, any other methods known in the art for joining covering portion 356 with mounting portion 354 could be used. Furthermore, it will be understood that the method of attaching covering portion 356 to mounting portion 354 may generally vary according to the types of materials comprising each portion.

In some cases, base portion 352 and covering portion 356 may be configured with substantially similar shapes. For example, in the current embodiment, first distal edge 353 of base portion 352 may have a substantially similar contoured shape to second distal edge 357 of covering portion 356. In other cases, however, base portion 352 and covering portion 356 could have substantially different shapes. For purposes of clarity, the following discussion describes the general shape of protective member 350, which is comprised of both base portion 352 and covering portion 356.

In different embodiments, the geometry of protective member 350 could be varied. For example, in one embodiment, protective member 350 has an approximately ring-like shape that is configured to encircle hole 320. However, in other embodiments, the shape of protective member 350 may not be ring-like. Instead, in other cases, protective member could have a box-like peripheral shape, a triangular-like peripheral shape as well as any other kind of peripheral shape. Moreover, in still other cases, protective member 350 may comprise one or more segmented portions that do not extend around the entirety of hole 320. For example, in other embodiments, protective member 350 could have a semi-circle shape.

Figure 8:
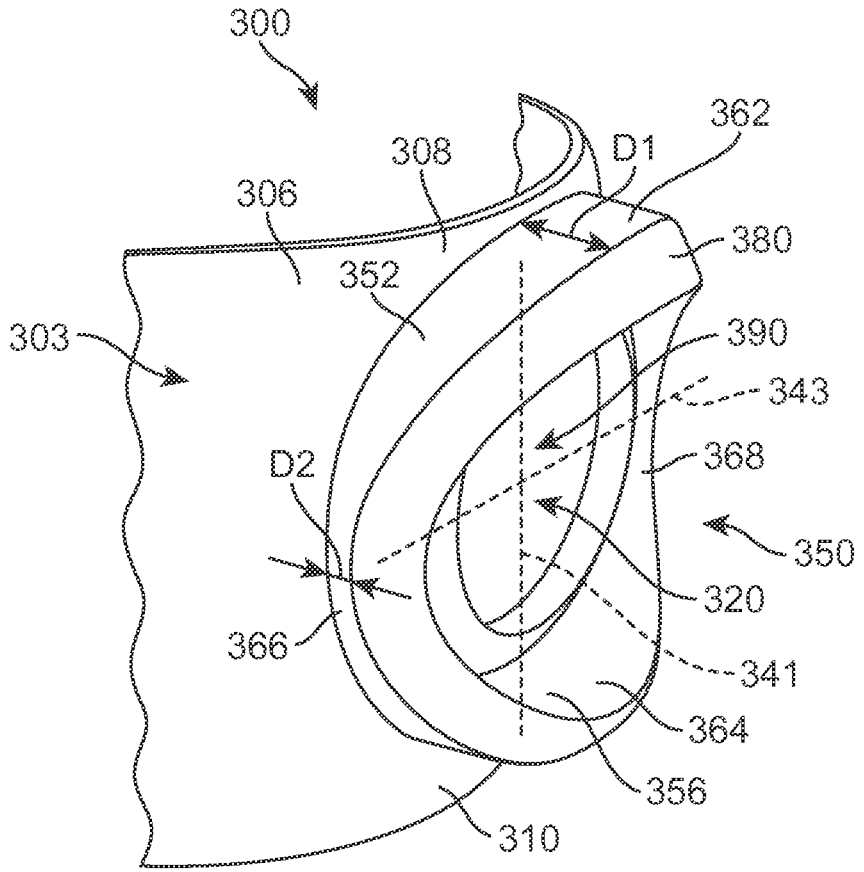
FIG. 8 is an enlarged isometric view of an embodiment of a protective member.

FIG. 8 illustrates an enlarged schematic view of an embodiment of protective member 350 for purposes of describing the geometry of protective member 350. In some embodiments, protective member 350 may include one or more protruding portions. In some cases, protective member 350 includes upper protruding portion 362 and lower protruding portion 364. In some cases, upper protruding portion 362 and lower protruding portion 364 may be disposed adjacent to upper portion 308 and lower portion 310, respectively, of rearward portion 306. Moreover, upper protruding portion 362 and lower protruding portion 364 each extend outwardly from distal surface 303 of heel member 300.

Protective member 350 may also include first shallow portion 366 and second shallow portion 368. In some cases, first shallow portion 366 may generally extend between upper protruding portion 362 and lower protruding portion 364. Likewise, in some cases, second shallow portion 368 may generally extend between upper protruding portion 362 and lower protruding portion 364. In some cases, first shallow portion 366 and second shallow portion 368 may be disposed on opposing sides of hole 320.

In some embodiments, different portions of protective member 350 may extend from distal surface 303 by different amounts. For example, upper protruding portion 362 and lower protruding portion 364 may be associated with an approximate depth D1 with respect to distal surface 303. Additionally, first shallow portion 366 and second shallow portion 368 may be associated with an approximate depth D2 with respect to distal surface 303. In some cases, depth D1 may be substantially greater than depth D2. In other words, in some cases, upper protruding portion 362 and lower protruding portion 364 may generally extend further from distal surface 303 than first shallow portion 366. Also, in some cases, upper protruding portion 362 and lower protruding portion 364 may generally extend further from distal surface 303 than second shallow portion 368.

For purposes of describing the geometry of protective member 350 in further detail, reference is made to a vertical axis and a lateral axis. In particular, as seen in FIG. 8, vertical axis 341 is an axis along a vertical direction of rearward portion 306. In other words, vertical axis 341 may extend between upper portion 308 and lower portion 310. In addition, lateral axis 343 is an axis that extends along a lateral direction of rearward portion 306 and which is generally perpendicular to vertical axis 341.

In some embodiments, protective member 350 may have a contoured geometry. In some cases, the depth of protective member 350 increases in an approximately continuous manner from depth D2 at first shallow portion 366 to depth D1 at upper protruding portion 362. Moreover, the depth of protective member 350 decreases from depth D1 at upper protruding portion 362 to depth D2 at second shallow portion 368. Also, the depth of protective member 350 increases from depth D2 at second shallow portion 368 to depth D1 at lower protruding portion 364. Finally, the depth of protective member 350 decreases from depth D1 at lower protruding portion 364 to depth D2 at first shallow portion 366. Moreover, the maximum heights for protective member 350 (corresponding to upper protruding portion 362 and lower protruding portion 364) occur approximately along vertical axis 341 of rearward portion 306. In other words, in some embodiments, upper protruding portion 362 and lower protruding portion 364 are aligned along vertical axis 341. Likewise, the minimum heights for protective member 350 (corresponding to first shallow portion 366 and second shallow portion 368) occur approximately along lateral axis 343 of rearward portion 306. In other words, in some embodiments, first shallow portion 366 and second shallow portion 368 are aligned along lateral axis 343.

In the current embodiment, upper protruding portion 362, lower protruding portion 364, first shallow portion 366 and second shallow portion 368 may be continuously formed with one another. However, in other embodiments, two or more portions could be disjoint or separated from one another. For example, in another embodiment, heel member 300 may include two separate protruding portions adjacent to upper portion 308 and lower portion 310 of rearward portion 306. In still another embodiment, first shallow portion 366 may be absent from protective member 350 so that protective member 350 forms only a partial ring around hole 320.

Figure 9:
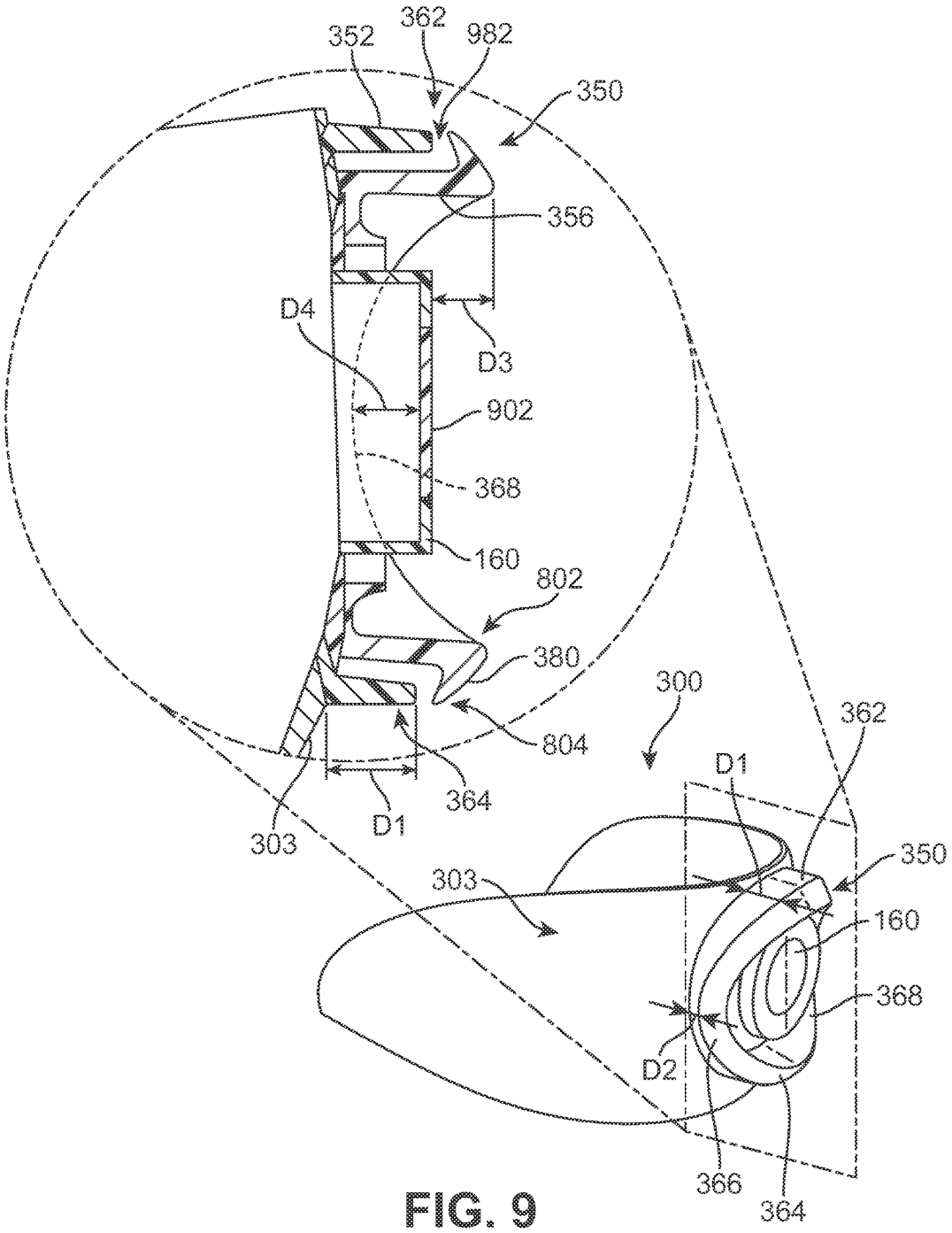
FIG. 9 is an isometric view as well as an enlarged cross sectional view of a heel member with a protective member, according to an embodiment.

FIG. 9 illustrates a schematic isometric view of heel member 300 with control device 160 inserted through hole 320 (see FIG. 8). In addition, FIG. 9 illustrates an enlarged cross-sectional view of a portion of protective member 350 and control device 160. As seen in FIG. 9, the depths of upper protruding portion 362 and lower protruding portion 364 may be selected so that upper protruding portion 362 and lower protruding portion 364 extend further from distal surface 303 than control device 160. In one embodiment, exterior surface 902 of control device 160 may be recessed by a depth D3 from upper protruding portion 362 and lower protruding portion 364 (see also FIG. 10).

In order to allow a user to access control device 160, the depths of first shallow portion 366 and second shallow portion 368 may be selected so that control device 160 extends further from distal surface 303 than first shallow portion 366 and second shallow portion 368. In one embodiment, first shallow portion 366 and second shallow portion 368 may be recessed by a depth D4 from exterior surface 902 of control device 160 (see also FIG. 10). Therefore, portions of control device 160 may be exposed at first shallow portion 366 and second shallow portion 368.

In some embodiments, the geometry of protective member 350 may include provisions for directing any object that contacts protective member 350 away from a control device and/or hole of a heel member. In some cases, one or more portions of protective member 350 may be sloped. In some cases, one or more portions of protective member 350 may be sloped away from a hole of a corresponding heel member.

Referring now to FIGS. 8 through 9, in some embodiments, protective member 350 may include sloped peripheral surface 380. Generally, sloped peripheral surface 380 may be a contoured surface that extends through upper protruding portion 362, lower protruding portion 364, first shallow portion 366 and second shallow portion 368. In some cases, sloped peripheral surface 380 may be disposed on covering portion 356. In other cases, however, sloped peripheral surface 380 may be disposed on another portion of protective member 350, including, for example, base portion 352.

For purposes of description, the term "radial" is used throughout this detailed description and in the claims to refer to a direction generally extending outwardly from a central axis of a protective member towards a peripheral portion. For example, in this particular embodiment, the radial direction extends outwardly from a central axis 390 (see FIG. 8) of protective member 350, which corresponds with a central portion of hole 320.

Sloped peripheral surface 380 may be sloped away from hole 320 and/or a control device. As seen in FIG. 9, sloped peripheral surface 380 may be sloped downwardly from first radial position 802 to a second radial position 804. Moreover, first radial position 802 is disposed radially inwards of second radial position 804. In other words, sloped peripheral surface 380 is configured to slope away from hole 320 and control device 902. With this arrangement, an object contacting protective member 350 may tend to slide down sloped peripheral surface 380. This helps to direct objects that may incidentally contact protective member 350 away from control device 902.

Figure 10:
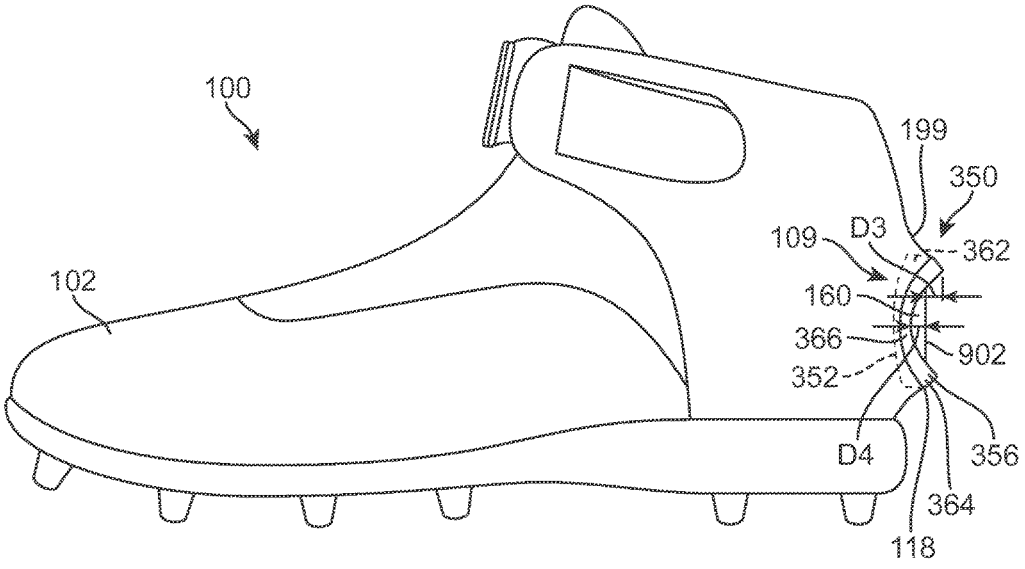
FIG. 10 is a side view of an embodiment of an article of footwear including a protective member.

FIG. 10 illustrates a side view of an embodiment of article 100 including protective member 350. As seen in FIG. 10, when assembled with article 100, protective member 350 may be associated with receiving region 109 of article 100. The term "receiving region" as used throughout this detailed description and in the claims refers to any region of an article that is configured to receive a control device. In some cases, a receiving region can include a hole for receiving a control device. For example, in the current embodiment, receiving region 109 for control device 160 comprises hole 118. In other cases, however, a receiving region could include any other provisions for receiving a control device.

In the current embodiment, protective member 350 extends outwardly from upper 102. In particular, first protruding portion 362 and second protruding portion 364 of protective member 350 extend outwardly from exterior surface 199 of upper 102. With the configuration, protective member 350 is configured to surround portions of control device 160 and thereby reduce incidental contact with control device 160. Moreover, first shallow portion 366 and second shallow portion 368 are recessed in order to allow a user access to portions of control device 160.

Although the current embodiment includes a protective member that is attached to heel member 300 (see FIG. 9), in other embodiments a protective member could be attached to any other component of an article. For example, in some cases, protective member 350 could be attached directly to upper 102. In still another embodiment, protective member 350 could be attached directly to an inner lining or bootie that is inserted into, or otherwise joined with, upper 102.

Some embodiments may include provisions for covering portions of a protective member. In some cases, a protective member may be configured so that some portions may be covered by a portion of an article, such as a portion of an upper. Referring to FIG. 9, for example, covering portion 356 could be separated from base portion 352 by a gap 982. In some cases, gap 982 provides a space where a portion or layer of an upper can be inserted or otherwise mounted. As shown in FIG. 10, for example, in some embodiments, upper 102 is configured to cover base portion 352 (shown in phantom), while covering portion 356 remains exposed. With this arrangement, covering portion 356 provides an aesthetic bezel for protective member 350.

In some cases, to achieve the current configuration, a portion of upper 102 may be installed over base portion 352 during one step of manufacturing. Following this, covering portion 356 may be installed over base portion 352 and the adjacent portion of upper 102. It will be understood, however, that in other embodiments the upper could be attached to protective member 350 after covering portion 356 has been installed.

While the current embodiment illustrates a configuration where part of protective member 350 is covered by upper 102, in other embodiments upper 102 may not cover any portions of protective member 350. For example, in some cases, base portion 352 can be completely exposed on exterior surface 199 of upper 102. In still other cases, some portions of base portion 352 may be exposed while others may be hidden. Moreover, in still other embodiments, portions of covering portion 356 may also be covered by upper 102.

Figure 11:
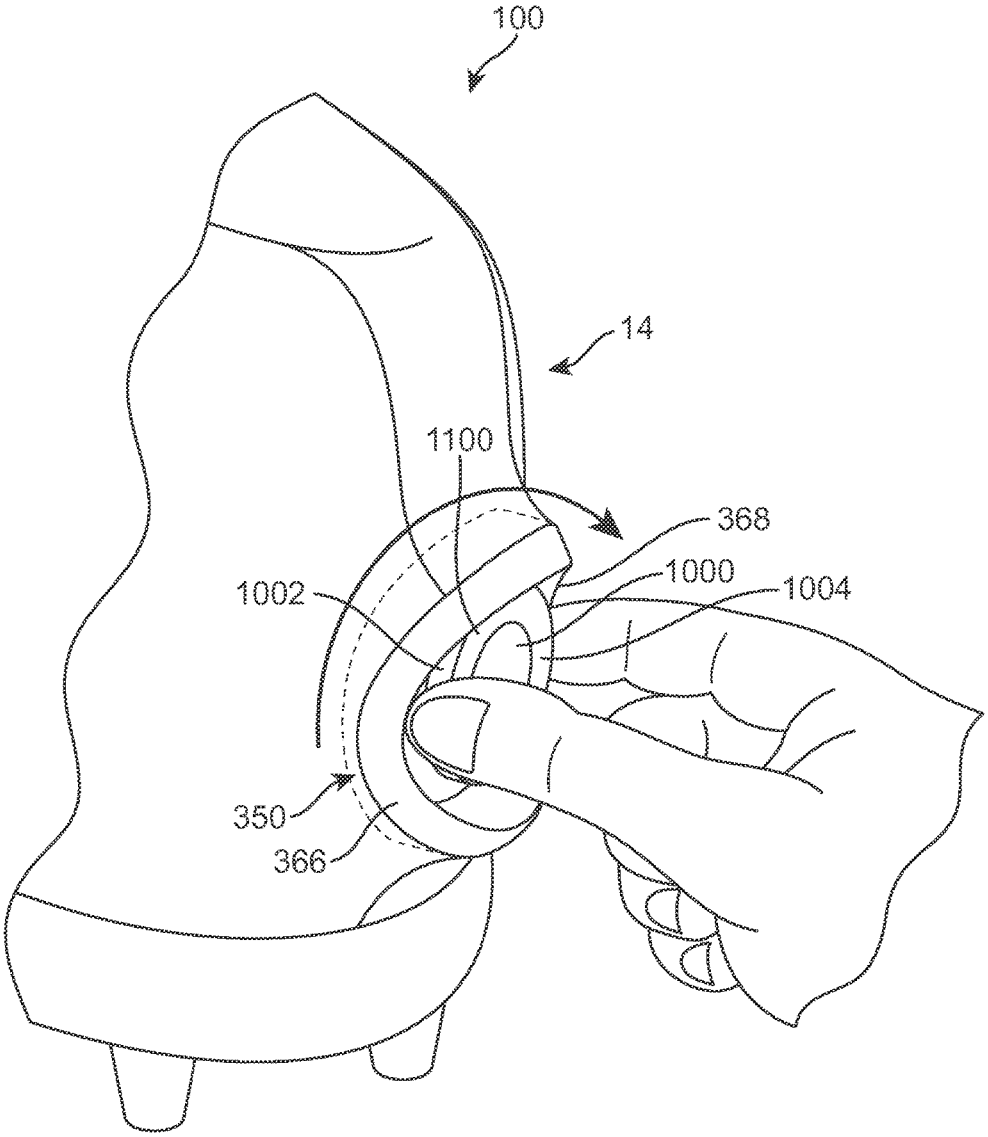
FIG. 11 is a schematic view of a user turning a control device according to one embodiment.
Figure 12:
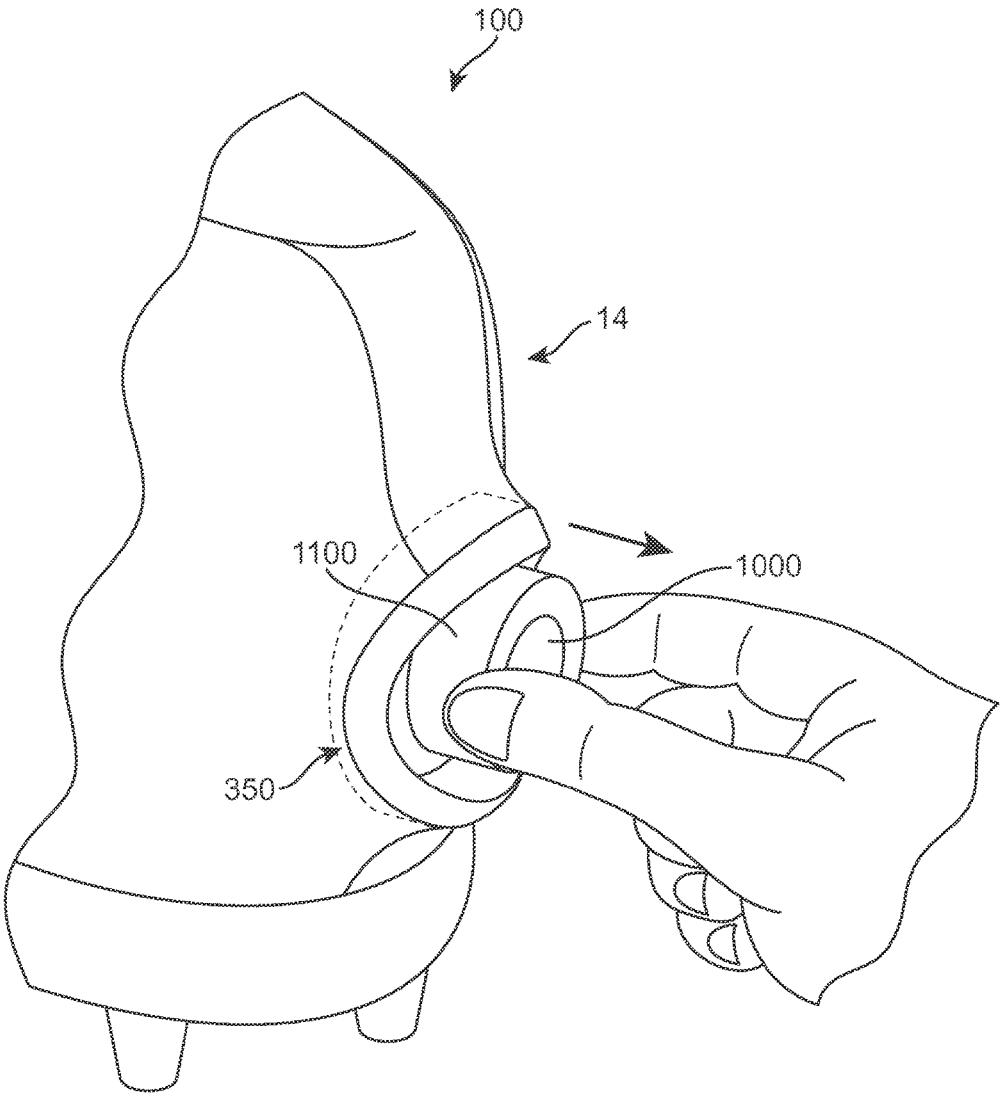
FIG. 12 is a schematic view of a user engaging a release mechanism of a control device according to one embodiment.

Referring to FIGS. 11 and 12, which illustrate schematic views of heel portion 14 of article 100, this arrangement provides controlled access to a control device. As seen in FIG. 11, a user may adjust control device 1000 by contacting control device 1000 at first region 1002 and second region 1004. Although control device 1000 is surrounded by protective member 350, first region 1002 and second region 1004 may be exposed to the user due to the relatively shallow depths of first shallow portion 366 and second shallow portion 368. Thus, for example, a user may increase the tension of fastening system 150 (see FIG. 1) by turning reel 1100 of control device 1000.

In the current embodiment, control device 1000 may be provided with a release mechanism for releasing the tension in fastening system 150. For example, in some cases, reel 1100 of control device 1000 may be a pop-out reel, as shown in FIG. 12. Therefore, a user may release tension in control device 1000 by pulling out pop-out reel 1100.

Figure 13:
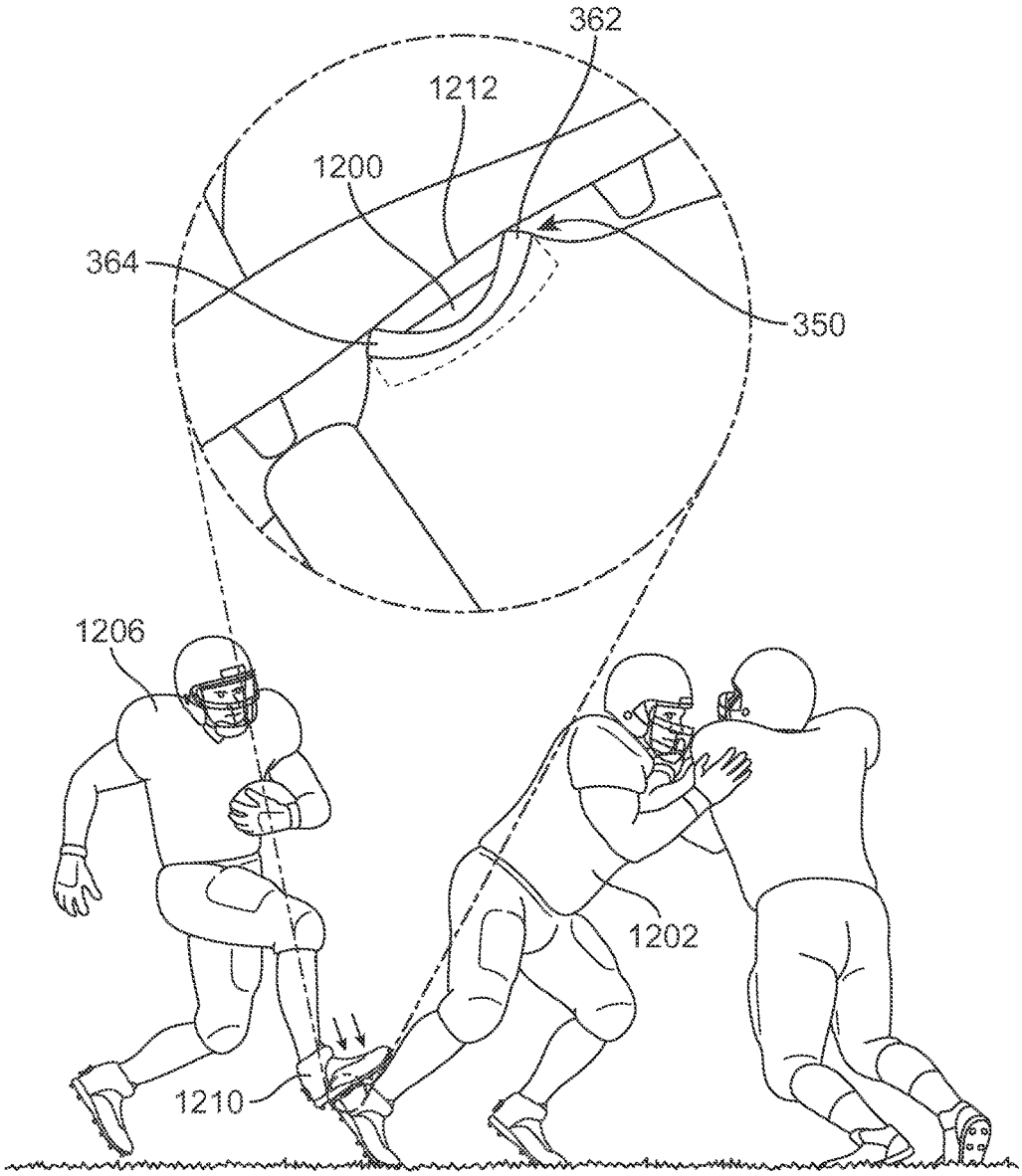
FIG. 13 is a schematic view of a protective member preventing accidental contact between a foot and a control device according to one embodiment.

FIG. 13 illustrates an exemplary game situation in which protective member 350 may help reduce incidental contact with control device 1200 and thereby prevent the inadvertent release of tension in a fastening system. In this situation, first player 1202 is attempting to block another player. A second player 1206, carrying the ball, is attempting to get past first player 1202. However, as shown in FIG. 13, second player 1206 may inadvertently step on the heel of first player 1202 in the process of running past the other players.

Referring now to the enlarged portion of FIG. 13, protective member 350 helps protect control device 1200 from contact with shoe 1210. Specifically, upper protruding portion 362 and lower protruding portion 364 both contact lower surface 1212 of shoe 1210. This contact prevents surface 1212 from coming into contact with control device 1200, which could possibly have the effect of engaging the release mechanism of control device 1200.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. A heel member for an article of footwear, comprising: a first side portion, a second side portion and a rearward portion between the first side portion and the second side portion and configured to wrap around a heel of a foot; a hole disposed in the rearward portion, wherein the hole is configured to receive a control device; the rearward portion further including a proximal surface and a distal surface; a protective member formed with the heel member having at least one protruding portion extending outwardly from the distal surface and a sloped peripheral surface portion, wherein the at least one protruding portion and the sloped peripheral surface portion are a single monolithic component of material; wherein the at least one protruding portion is substantially cylindrical and is configured to extend further from the distal surface than the control device when the control device is installed in the article of footwear; wherein the sloped peripheral surface portion is disposed adjacent to the hole; and wherein the at least one protruding portion is positioned a first distance from the center of the hole, the sloped peripheral portion is positioned a second distance from the center of the hole, and the first distance is greater than the second distance.

2. The heel member according to claim 1, wherein the protective member further comprises a second protruding portion.

3. The heel member according to claim 2, wherein the at least one protruding portion is disposed adjacent to an upper portion of the rearward portion and the second protruding portion is disposed adjacent to a lower portion of the rearward portion.

4. The heel member according to claim 2, wherein the protective member encircles the hole.

5. The heel member according to claim 4, wherein the sloped peripheral surface portion slopes down in a radially outward direction.

6. The heel member according to claim 5, wherein the sloped peripheral surface portion helps direct objects contacting the protective member away from the hole.

7. An article of footwear, comprising:

an upper portion having an inner surface;

a heel portion including an exterior surface;

the heel portion including a receiving region, the receiving region being configured to receive a control device;

a protective member having a central opening, a protruding portion extending outwardly from the exterior surface of the heel portion, a gap and a sloped peripheral surface portion;

wherein the protruding portion is substantially cylindrical and extends a first distance from the exterior surface;

wherein the sloped peripheral surface portion slopes away from the central opening and is disposed adjacent to the receiving region;

wherein the gap separates the protruding portion and the sloped peripheral surface portion; and wherein the upper portion is inserted into the gap and the inner surface of the upper portion is disposed against the protruding portion.

8. The article of footwear according to claim 7, wherein the protruding portion is integrally formed to a heel member of the article of footwear.

9. The article of footwear according to claim 8, wherein the heel member is a heel counter.

10. The article of footwear according to claim 7, wherein the receiving region includes a hole.

11. The article of footwear according to claim 10, wherein the protective member extends through the hole.

12. The article of footwear according to claim 7, wherein the protruding portion is configured to extend further from the exterior surface than the control device when the control device is installed in the article of footwear.

13. The article of footwear according to claim 7, wherein the height of the protruding portion varies.

* * * * *